US005823463A

United States Patent [19]

Fissmann et al.

[11] Patent Number: 5,823,463

[45] Date of Patent: Oct. 20, 1998

[54] WOUND ROLL SUPPORT IN A WEB WINDING MACHINE

[75] Inventors: Hans-Joachim Fissmann, Konstanz; Matthias Wohlfahrt, Ulm, both of Germany

[73] Assignee: Voith Sulzer Papiermaschinen GmbH, Germany

[21] Appl. No.: 804,814

[22] Filed: Feb. 24, 1997

[30] Foreign Application Priority Data

Feb. 23, 1996 [DE] Germany ..... 196 06 755.3

[51] Int. Cl.[6] ..... B65H 18/14

[52] U.S. Cl. ..... 242/541.7; 242/542.4

[58] Field of Search ..... 242/541.7, 541.4, 242/541.5, 541.6, 542.4, 908

[56] References Cited

U.S. PATENT DOCUMENTS

| | | | |
|---|---|---|---|
| 3,346,209 | 10/1967 | Cronin | 242/541.7 |
| 3,497,151 | 2/1970 | Voss et al. | 242/541.7 |
| 3,515,183 | 6/1970 | Voss | 242/541.7 |
| 3,549,098 | 12/1970 | Helkala | 242/542.4 |
| 3,837,593 | 9/1974 | Dorfel | 242/542.4 |
| 3,869,095 | 3/1975 | Diltz | 242/542.4 X |
| 4,487,377 | 12/1984 | Perini | 242/542.4 X |
| 4,541,585 | 9/1985 | Frye et al. | 242/542.4 |
| 4,732,341 | 3/1988 | Ruff . | |
| 4,749,140 | 6/1988 | Ruff . | |
| 5,026,005 | 6/1991 | Ehrola | 242/541.5 |
| 5,335,871 | 8/1994 | Fissmann et al. | 242/542.4 X |
| 5,505,403 | 4/1996 | Raudaskoski | 242/542.4 X |

FOREIGN PATENT DOCUMENTS

| | | | |
|---|---|---|---|
| 1047001 | 12/1958 | Germany | 242/541.7 |
| 3541906 | 2/1987 | Germany . | |
| 92017961 | 4/1992 | Germany . | |
| 4409036 | 9/1995 | Germany . | |
| 1256451 | 10/1989 | Japan | 242/542.4 |
| 2226304 | 6/1990 | United Kingdom | 242/542.4 |

*Primary Examiner*—Donald P. Walsh
*Assistant Examiner*—William A. Rivera
*Attorney, Agent, or Firm*—Strolenk, Faber, Gerb & Soffen, LLP

[57] ABSTRACT

A winding machine for a continuous web includes at least two support rollers defining a bed for the wound web. At least one roller has a rotatable, perforated roller shell. A stationary pressure box disposed inside the roller shell which is opened toward the inner surface of the perforated shell and is connectable to a source of pressure air. A further longitudinally extending packing closes the bottom of the gap between the first and second rollers. Longitudinal packings at the pressure box define a pressure zone extending approximately from the further packing to the place where the round roll lies on the one support roller. A suction zone is defined at the support roller upstream in the direction of roll shell rotation from the pressure zone. A grid of walls along the pressure zone in the pressure box define axially shorter length individually pressurizable zones connectable to a pressure source. In an alternate embodiment, three support rollers define two roll beds. The first and third of the rollers are support rollers as described above.

24 Claims, 5 Drawing Sheets

WOUND ROLL SUPPORT IN A WEB WINDING MACHINE

BACKGROUND OF THE INVENTION

The present invention relates to a winding machine for the winding or unwinding a web of material, for example a paper web, which is particularly designed to support the wound roll to reduce pressure on the web on the bed where the roll is being supported.

Known winding machines are described, for instance, in U.S. Pat. No. 3,515,183 and Federal Republic of Germany Patent 35 41 906.

Winding machines in accordance with U.S. '183 have two rotatable wound roll support rollers, which form a so-called roll bed for the wound roll or rolls. There are a plurality of rolls if the web of material is divided longitudinally before being wound. Winding machines in accordance with Germany '906 all are for winding a longitudinally divided web onto several winding rolls. For example, there may be three or four support rollers which form two roll beds that lie alongside each other for in each case about half of the wound rolls.

The following details are also known from U.S. '183: Each of the roll support rollers has a rotatable perforated roller peripheral wall or shell within the roll. A stationary pressure box is disposed inside the roller shell, is open toward the inner surface of the roller shell and can be connected to a source of compressed air. Sealing slots are formed by the longitudinally extending walls or packings of the pressure box which together with the inner surface of the shell, limit a pressure zone. The pressure zone is relatively narrow circumferentially. It is located at the place where the wound roll lies on the support roller wall. This attempts to avoid damage to the web due to the weight of the wound roll at its contact zone with the support rollers during the winding or unwinding. The danger of such damage to the web increases as the maximum diameter of the wound roll becomes larger. It is known that processing webs of material, and particularly webs of paper, can be carried out more economically the larger is the maximum diameter of the wound roll.

Disadvantages of the construction in U.S. '183 are: It is necessary to provide each of the two support rollers with a perforated roller shell and with a stationary pressure box. Furthermore, the pressure boxes must be displaceable along the circumferential direction of the roller during operation, so that the pressure zone can be adapted continuously to the varying position of the place of contact with the wound roll. Another disadvantage is that a very high air pressure must be established in the pressure zone to achieve the desired effect.

Another more promising method for counteracting the weight of the wound roll or wound rolls is disclosed in Federal Republic of Germany Publication 40 04 198. In that method, a pressure cushion is formed in the entire space present between the wound roll and the two support rollers. For this purpose a compressed air box, which forms packing material gaps with the outer shell surfaces of the support rollers, is provided below the space between the two support rollers. One disadvantage of this construction is that it is relatively expensive to be able to movably support the relatively large compressed air box. It must be possible to remove the box from its operating position, particularly, because it must be frequently cleaned and/or freed of the waste paper which is occasionally produced and in many cases also for introducing the starting end of the web of material.

SUMMARY OF THE INVENTION

The object of the present invention is to provide a winding machine which relieves the weight of the wound roll and which is as easy as possible to handle and as insensitive to dirt as possible.

This object is achieved by a support roller arrangement wherein at least one support roller includes an air pressure supply box located inside a perforated, rotatable roller shell. Circumferentially spaced apart, longitudinally extending first and second packings in the shell define a pressure zone. A further longitudinal packing is disposed in the bottom of the gap between the rollers. The first packing in the shell is generally at the further packing, while the second packing in the shell is generally where the wound roll rests on the one support roller. End shields close the gap making it a pressure zone.

The invention modifies the arrangement in U.S. '183 so that, as a rule, only one of the roll support rollers has a stationary pressure box within it, and this box defines a circumferentially substantially larger pressure zone than in U.S. '183. This pressure zone extends circumferentially from about the narrowest gap between the two support rollers up into the circumferential region where the wound roll lies on the corresponding support roller. This produces a compressed air cushion in the space present between the wound roll and the support rollers which counteracts the weight of the wound roll on the rollers. This is effected using entirely different means than in Federal Republic of Germany '198. In the present invention, only a single longitudinally extending sealing element is necessary in order to seal off the gap between the two adjacent support rollers. The sealing element may, for instance, be in the form of a roller but preferably, however, is in the form of a further longitudinally extending packing extending beneath the gap between the support rollers. Since this longitudinally extending packing is relatively simple and light weight (as compared with the compressed air box of Federal Republic of Germany '198), if necessary, the strip can be removed temporarily in the downward direction by means of a simple lifting or swinging device. The compressed air cushion is limited at the two axial ends of the wound roll in known manner by a side shield located at each end.

The invention has advantages: Since only a relatively slight pressure is necessary for the compressed air cushion, it is sufficient, as a rule, for only one of the two roll support rollers to have a perforated shell and to be provided with an internal stationary pressure box. Thus, the other support roller can in many cases have a normal or non-perforated roller wall or shell. In many cases, the other support roller may also be developed as a suction roller, in accordance with Federal Republic of Germany Patent 38 43 246, but without stationary inserts. Another advantage results because the internal pressure box need not be displaceable in a circumferential direction, but can instead be arranged fixed in position in the perforated shell of the support roller. This enables considerable savings in the construction of the winding machine.

Based on the experience in the construction of paper machine suction rollers, the stationary pressure box and its corresponding packings which are, for instance, formed from strips of felt, can be produced in such a manner that the packings have an astonishingly long life. Furthermore, the internal pressure box remains free of dirt or dust even after prolonged operation, avoiding expense for cleaning it.

The relatively light longitudinally extending packing strip which can be introduced between and below the rollers requires relatively little space and also little expense for cleaning. The machine is very rapidly capable of restarting its operation, saving time. The longitudinal packing strip can also, if needed, be easily combined with a separating device in accordance with Federal Republic of Germany Patent 3109587.

Every existing traditional winding machine can be retrofitted within only a relatively short retrofitting time with the device of the invention in order to form a compressed air cushion.

Federal Republic of Germany Patent 38 43 246 discloses that a vacuum must be produced within a perforated support roller during the change in rolls in order to hold each new starting end of the web on the roll support roller after the partial webs have been cut. During normal winding, the perforated shell of the roller furthermore assures that the air boundary layers which arrive with the web can escape through the inside of the roller. One disadvantage of this known suction roller is that, during suction, a large amount of infiltrating air is drawn into the part of the wall of the roller that is not covered by the web. On the other hand, the support roller of the invention, with stationary inserts offers the following possibilities: The pressure box can be temporarily connected, i.e., during the change of rolls, to a source of vacuum. Alternatively, an additional vacuum zone can be added to the pressure box, particularly in that region of the shell of the roller at which the starting end of the web lies on the support roller during the change in rolls.

In a further concept of the invention, the winding machine in accordance with Federal Republic of Germany '906 can be developed as a three-roller roll cutting machine. The three roll support rollers form two roll beds so that the partial webs produced during longitudinal cutting are wound up to form wound rolls in part on one roll bed and in part on the other roll bed. It is also possible for the two roll beds to be formed by four support rollers. In all cases, each wound roll is produced on a roll tube and is guided by two roll brackets. For each roll bracket, a clamping head, which engages into the roll tube, is mounted in a vertically displaceable tube guide. This construction enables a relief in weight, but in all cases only at the ends of each wound roll. This is not always sufficient, particularly with wide wound rolls. Additional pneumatic weight relief can provide assistance here. In that case, the perforated support roller provided with a stationary pressure box in accordance with the invention must be further developed such that it has a separate pressure zone over its length for each partial width wound roll concerned that is to be relieved of pressure. Furthermore, if necessary, a separate vacuum zone can then also be provided for each wound roll.

Generally, it should be possible to periodically change the width of the partial rolls in such a three or four roller roll winding machine. Therefore, in accordance with the invention, each pressure and/or vacuum zone is limited by two axially displaceable circumferential packings.

A further requirement may be that not only the web width of the wound rolls but also the number of wound rolls may be varied. This additional requirement can also be satisfied according to the invention in the manner that the number and length of the pressure zones can be varied. For this purpose, the entire pressure box is divided along the axis of the roller into a usually large number of small or axial length zones or sections. Each zone can be connected under individual control to the source of pressure.

Another manner of construction in accordance with the invention permits a particularly fine variation of the number and length of the pressure zones. This may include a grid of walls along the pressure box and each extending to the interior of the roll shell. They can be selected or positioned to set the length of a pressure zone section. Also, the grid walls may include pressure passage openings through them which are selectively sealable, thereby to define the limits of an individual section.

Other features and advantages of the present invention will become apparent from the following description of the invention which refers to the accompanying drawings.

DETAILED DESCRIPTION OF EMBODIMENTS OF THE INVENTION

Figure 1:
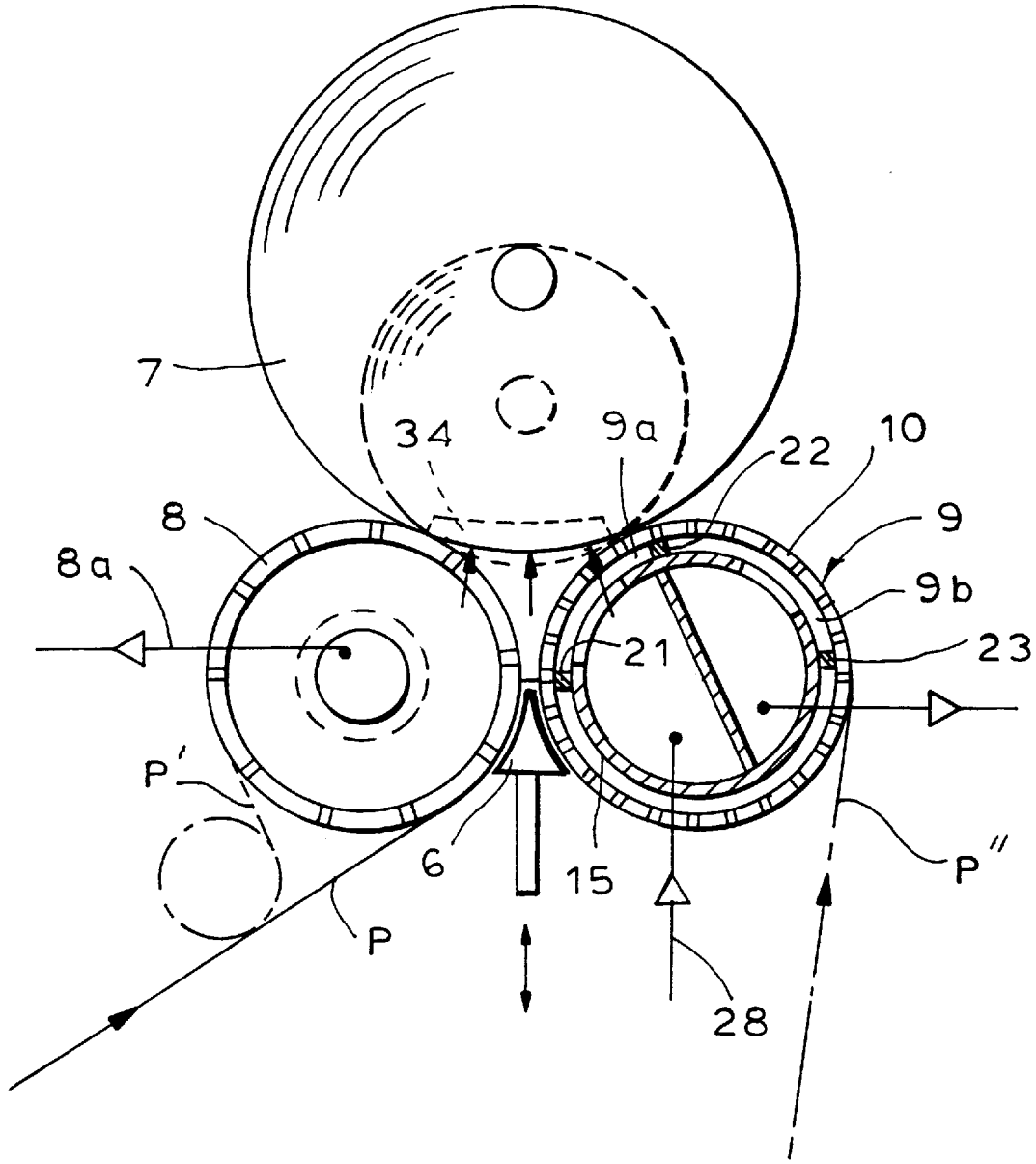
FIG. 1 is a diagrammatic side view of a two roller winding machine according to the invention.

The winding machine shown in FIG. 1 can be used for winding or unwinding a single wound roll. Generally, however, it forms the winding station of a roll cutting machine. Two roll support rollers 8 and 9 are present. One roller 9 has a rotatable, perforated roller shell 10 and an inner stationary air pressure box 15 inside the shell supplying elevated air pressure to the inside of the shell. The other roller 8 can have a rotatable, air impervious roller shell or a perforated roller shell (for instance in accordance with Federal Republic of Germany '246), but the latter can be without stationary inserts. However, it is also conceivable for both rollers 8 and 9 to have perforated roller shells and to be provided with respective stationary pressure boxes within the shells. The feed of the paper web to be wound can take place along the path P, but the feed is preferably along the path P' or may even be along the path P". In the latter case, the feed is over the roll support roller 9 that is provided with a pressure box. Travel over any of these paths produces the wound roll 7.

The space between the wound roll 7 and the rollers 8 and 9 is sealed off from below by a longitudinally extending packing strip 6 which is of a width in FIG. 1 to substantially fill the gap between the rollers 8, and 9 and the external surfaces of the strip 6 are curved generally to conform to the profiles of those rollers. The space between the rollers is also sealed off at its two ends by respective side shields, which are not visible. The feeding of compressed air through the stationary pressure box 15 and then through the holes in the roller shell 10 defines a compressed air cushion in the space which counteracts the weight of the wound roll. The stationary pressure box 15 supports, among other things, a longitudinally extending packing 21 located circumferentially near the narrowest gap between the rollers 8 and 9. It further supports a longitudinally extending packing 22 located near the circumferential place where the wound roll 7 rest on the roller 9. (That location changes with the diameter of the winding roll.) The two longitudinal packings 21 and 22 define a pressure zone 9*a* between them and inside the roller shell. Feeding the web along the paths P' or P" assures that no air passes out from the pressure cushion between the layers of web of the wound roll 7. For feeding on the web path P", a suction zone 9*b* is defined around the roll 9 inside the roller shell by and between longitudinally extending packings 22 and 23. The web can be held fast upon the change of the rolls due to the pressure box 15 in the support roller 9, if necessary.

For feeding the web along the web path P", the shell of the support roller 8 is preferably not perforated so that no air escapes from the compressed air cushion through that roller shell. In the case of web travel along the web paths P or P', the support roller 8 is provided with a suction connection 8*a*, and its wall has only very fine perforations in order to minimize the escape of air from the compressed air cushion inside the roller shell.

Figure 2:
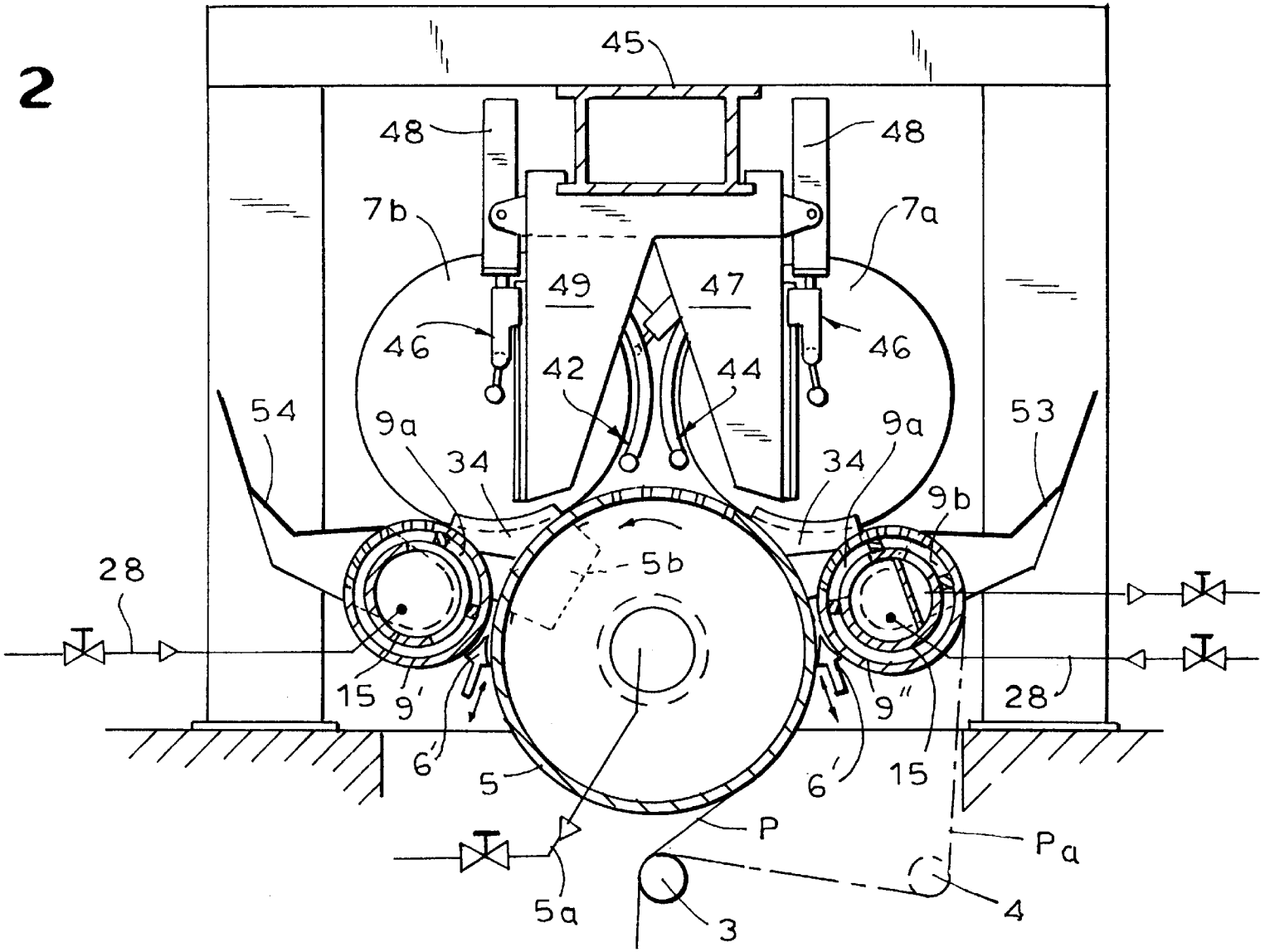
FIG. 2 is a diagrammatic side view of a three roller winding machine according to the invention.

FIG. 2 shows a three-roller winding machine having a middle support roller 5 and two outer, smaller support rollers 9' and 9". Two roll beds are defined between the central roller 5 and each of the side rollers 9' and 9". The lengthwise cut web of material, for instance a web of paper, travels along the path P over the central support roller 5 and into the machine. At least one of the cut partial width webs is wound up on the support rollers 5 and 9" to form a first roll 7*a*. At least one second partial web is wound up over the rollers 9" and 5 to form a second roll 7*b*.

According to a variant, one can also proceed as follows. The lengthwise cut partial webs are separated already on the circumference of a web guide roller 3, so that the at least one partial width web which is intended for forming a wound roll 7*a* (or several partial web rolls across the width of the machine) enters the machine along the dash-dot path Pa over another guide roller 4 and over the support roller 9". The other partial web or webs travel as previously described along the path P over the support rollers 5 and 9' onto the wound roll 7*b*.

The respective spaces between the wound rolls and the respective support rollers are again sealed off from the outside by longitudinally extending packing strips 6' below those spaces and by end packing elements 34, for instance "side shields", so that a compressed air cushion can be built up in the pressure spaces, by the pressure boxes 15 and compressed air lines 28, as described with reference to FIG. 1.

Further details form the object of a parallel patent application Ser. No. 08/804,898 filed on the same date by the same inventors and relating to wound web roll support.

Longitudinally or axially displaceable roll brackets 47, 49 extend downward into the corresponding roll bed for guiding the wound rolls 7*a*, 7*b* on both sides. The brackets are mounted on a longitudinally or axially extending beam 45. Each of the roll brackets 47, 49 has a tube guide 46 which is vertically displaceable by means of a lift device 48. Each tube guide 46 supports an axially displaceable clamping head which engages into the center of the corresponding wound roll, which center is formed by a roll tube. Roll ejection devices 42, 44 for feeding wound rolls to roll lowering devices 53, 54 are provided.

The middle support roller 5 has a roller shell, which is preferably perforated according to Federal Republic of Germany Patent 3843246, and it has a suction connection 5*a*. This enables a temporary vacuum to be produced within the support roller 5, particularly in order to hold the new starting ends of the partial webs on the support roller 5 during the change in rolls after the cutting of the web.

If necessary, a stationary cover 5*b*, which prevents the escape of compressed air through the perforations, can be provided in the region of the compressed air cushion formed below a wound roll 7*b*.

The roller 9" may have a vacuum zone 9*b*.

Figure 3:
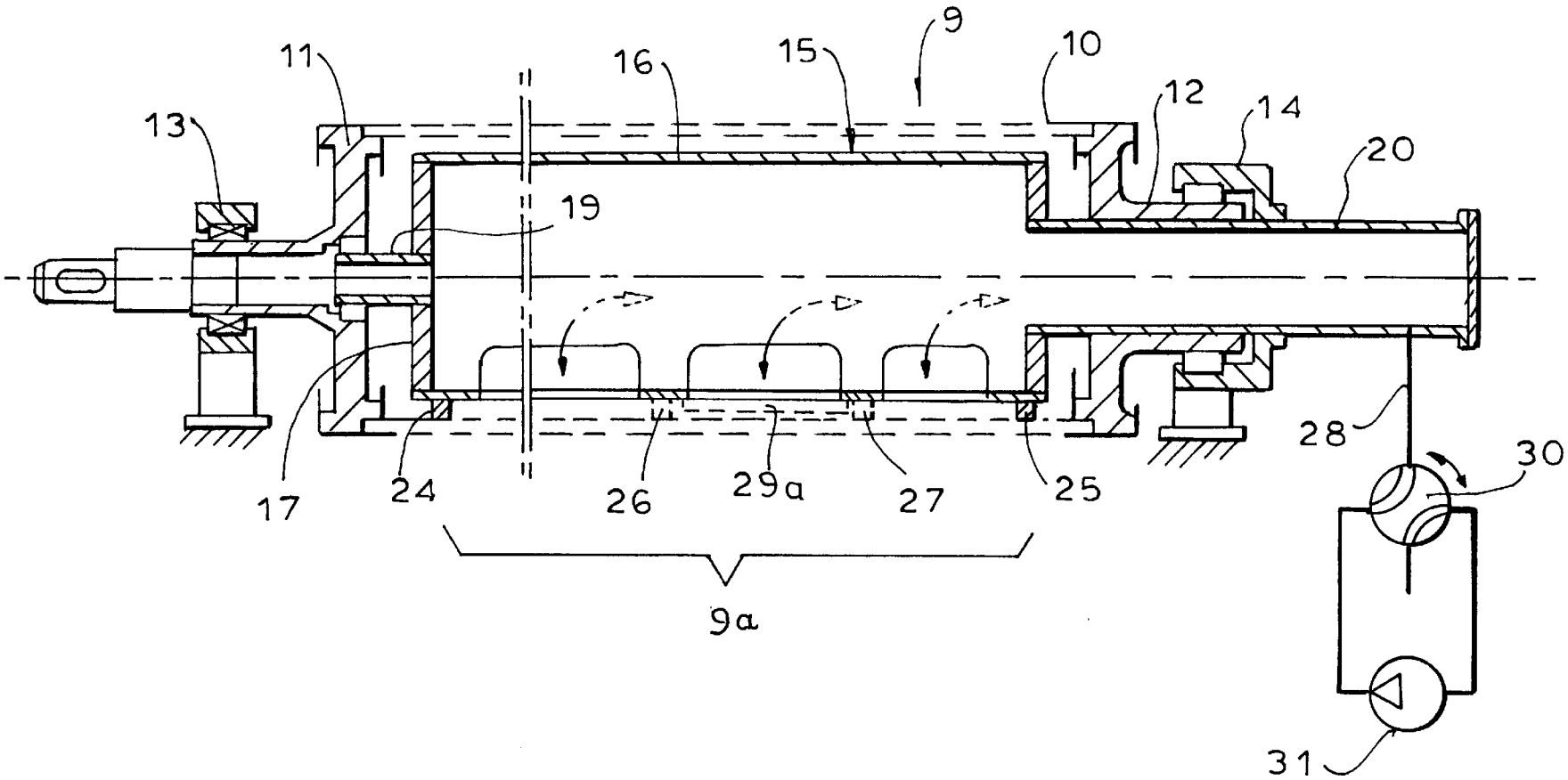
FIGS. 3, 4 and 5 each show a different roll support roller embodiment in longitudinal section.

FIG. 3 shows a first possible design for the roll support roller 9 of FIG. 1 or 9' or 9" of FIG. 2. A perforated roller shell 10 is diagrammatically shown. It rests in bearings 13 and 14 and is rotatable by means of the customary elements, like roller covers 11 and 12. There is a stationary pressure box 15 within the roller having a pressure zone 9*a* defined by longitudinally extending packings 21 and 22 (FIG. 1) and by circumferentially extending packings 24, 25. The box 15 has a circular wall 16, for instance, with openings 29 and end walls 17 and 18 that close the box. The box 15 is supported at one end by a pressure pipe 20 on the housing of the bearing 14 and is supported on the other end by a connection 19 and a bearing in the roller cover 11.

To use the roller 9 of FIG. 3 in a two roller winding machine as in FIG. 1, a single pressure zone is provided which extends substantially over the entire length of the pressure box 15. To use the roller in the three-roller winding machine of FIG. 2, on the other hand, then additional circumferential packings, and possibly an impermeable cover at 29*a* over part of the length of the roller shell, are necessary, for instance, to form two pressure zones which are axially separated from each other along the roller. The circumferential packings 24–27 are displaceable parallel to the axis of rotation of the roller or can be fastened in different positions along the wall 16.

FIG. 3 furthermore shows a possibility of connecting the inside of the box 15 optionally with the pressure side or the suction side of a blower 31 via the line 28 with the aid of a reversing valve 30. Upon the change of the rolls and as long as the compressed air cushion is not required, vacuum can be produced in a part of the holes in the roller shell 10 in order to hold the web fast on the support roller 9.

Figure 4:
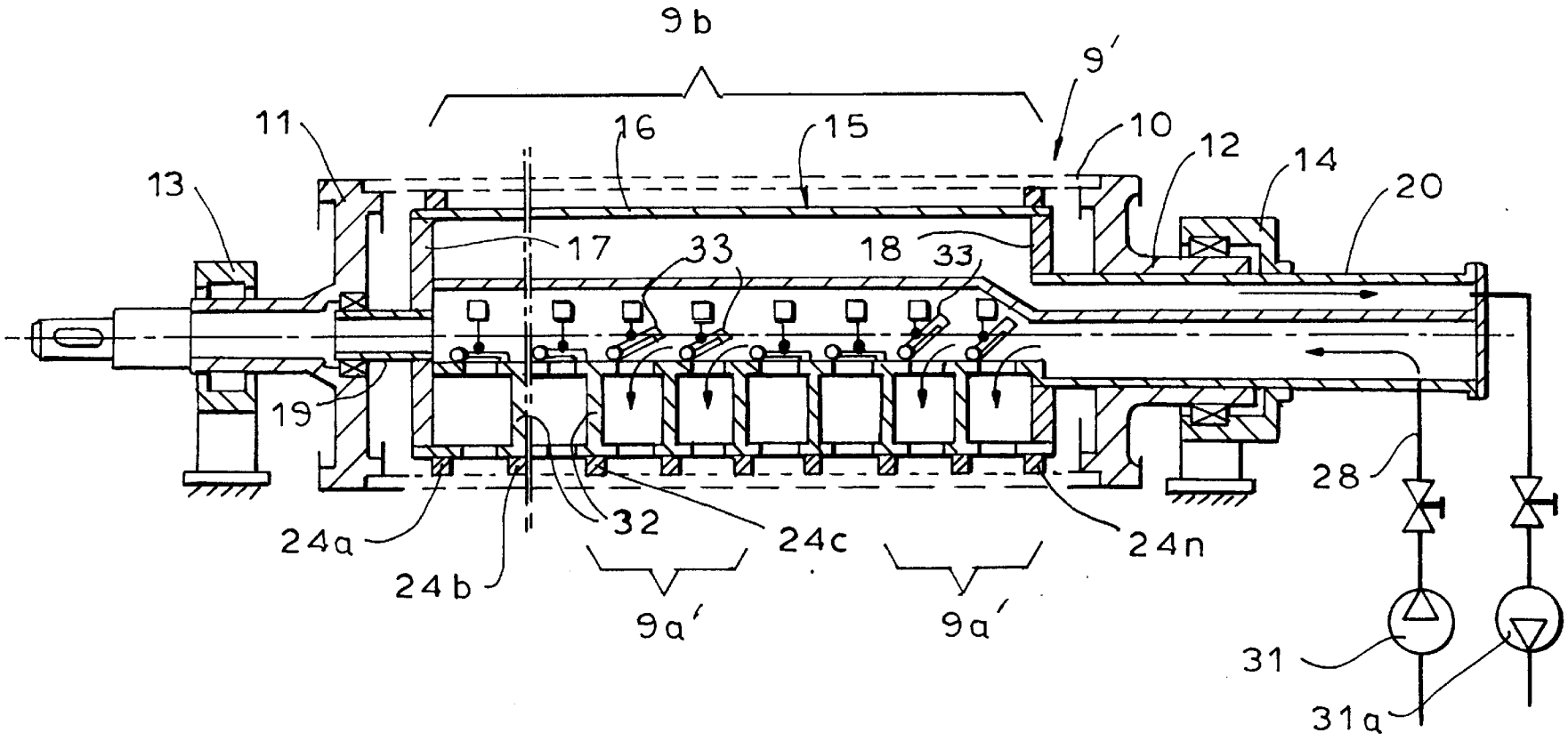

Another possibility is shown in FIG. 4. In that case, in addition to individual pressure zones 9*a*' which are longitudinally separated from each other and are arrayed along one circumferential side of the roller, there is a continuous vacuum zone 9*b* along another circumferential region of the roller, which can be connected temporarily to a source of vacuum 31*a*. As an alternative to FIG. 4, each individual pressure zone 9*a*' could have an individual vacuum zone associated with it. FIG. 4 furthermore shows the pressure side divided by numerous circumferential packings 24*a*–24*n* and corresponding partition walls 32 into a plurality of sections arranged in a row one after the other along the axis of the roller. Each section can be connected to the source of compressed air 31 by an individually controllable open/closed valve 33. In this way, the number, and lengths of the individual pressure zones 9*a*' can be determined and, if necessary, changed again. This method is sufficient if a relatively coarse grid is permissible for the purpose of the invention.

Figure 5:
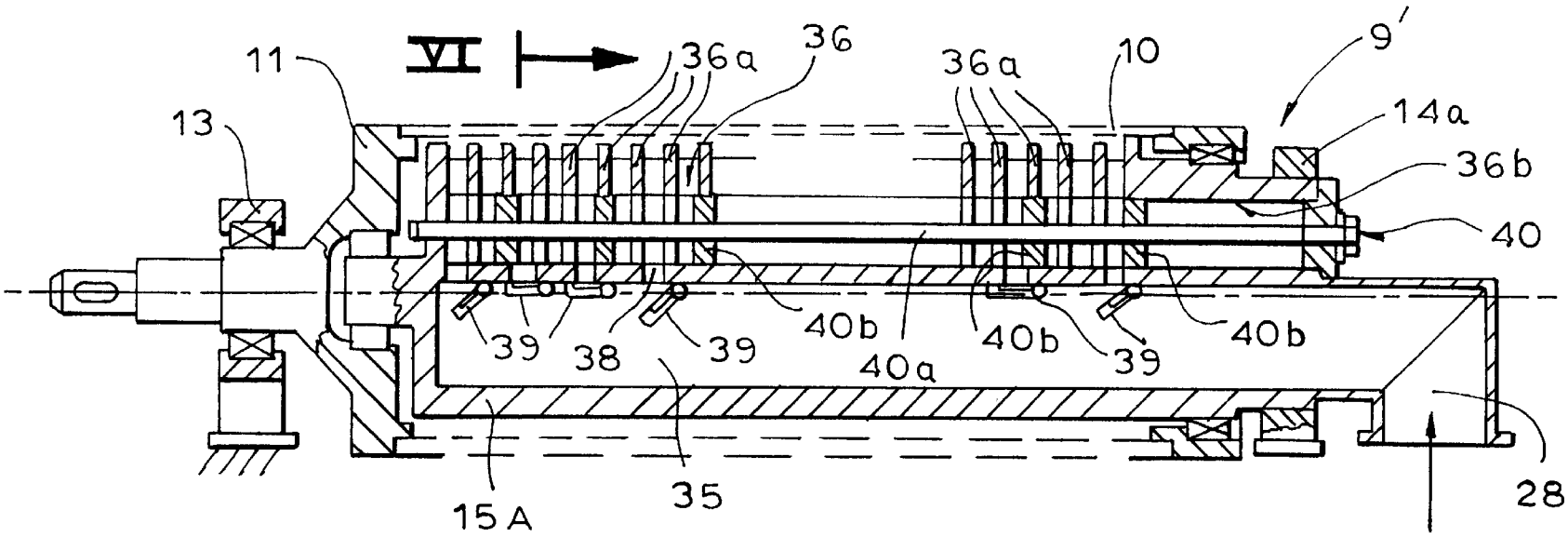
Figure 6:
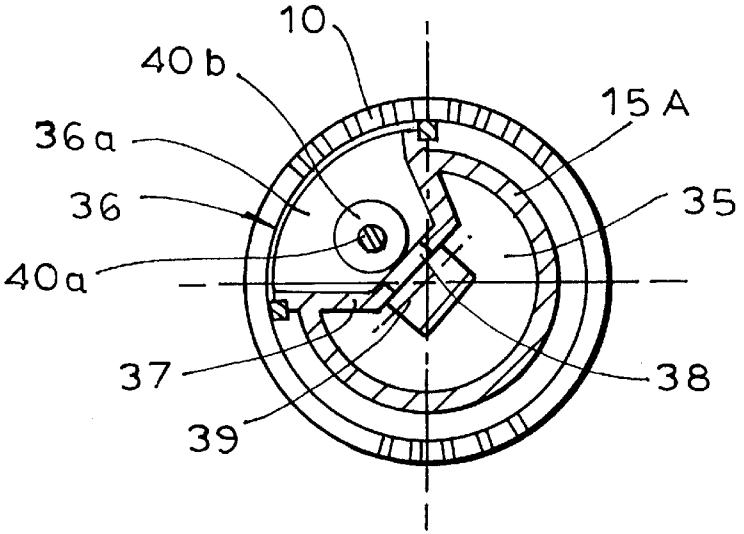
FIG. 6 is a cross section along the line VI of FIG. 5.

FIGS. 5 and 6 show another alternative construction of a support roller 9' in which the pressure zones are divided with a substantially finer grid. The pressure box 15*a* is divided for this purpose into a pressure chamber 35, which extends over the entire length of the roller, and a grid body 36. The division is done by a partition 37 having numerous openings 38 which can be controlled by means of valves 39 in a manner similar to FIG. 4. The grid body 36 is open towards the interior of the roller shell 10. It has a plurality of grid walls 36*a* oriented perpendicular to the axis which form sealing slots with the inner surface of the shell of the roller. The distance between two adjacent grid walls can be relatively small and, in any event, may be substantially less than the smallest possible distance between two valves 39. A paraxial hole 36*b* extends through all of the grid walls 36*a* which are perpendicular to the axis and forms a respective recess in each grid wall. A so-called control body 40 comprised substantially of a rod 40*a* can be inserted into this hole. A plurality of sealing disks 40*b* whose outside diameter corresponds to the diameter of the hole 36*b* can be fastened to that rod. The quantity and positions of the sealing disks may be any selected for a particular roller and particular web arrangement. Therefore, each sealing disk is associated with a previously selected grid wall 36*a*. This produces sections of any desired number, position along the roller and axial size. Selected sections may be communicated with compressed air by opening or closing their corresponding valves 39. One end of the stationary pressure box 15A rests directly in a support 14*a*. Alongside of it, the wall 10 of the roller is mounted rotatably on the pressure box 15A.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A machine for winding or unwinding a web roll of material having a width and a weight, the winding machine comprising:

at least first and second support rollers, each having a peripheral surface along its width, the support rollers being disposed proximate to one another such that the peripheral surfaces rollably support the web roll;

a rotatable and perforated roller shell forming the peripheral surface of the first support roller and having an inner surface defining an interior, the shell being rotatable about a stationary axis;

a gas pressure box being connectable to a source of pressurized gas and located in the interior of the perforated roller shell of the first support roller, the pressure box having an outer surface which includes an opening for permitting the pressurized gas to pass;

a first packing element having an exterior surface in slidable communication with the peripheral surfaces of the support rollers and extending along their widths;

the exterior surface of the first packing element, the peripheral surfaces of the rollers and an area of the web roll between the peripheral surfaces of the rollers defining a volume substantially beneath the web roll; and circumferentially spaced apart second and third packing elements extending longitudinally along the pressure box between the outer surface of the pressure box and the inner surface of the perforated roller shell for defining a pressure zone between the second and third packing elements;

the opening in the pressure box communicating with the pressure zone and the pressure zone communicating with the volume through the perforations in the roller shell such that gas pressure is increased in the volume which counteracts the weight of the web roll.

2. The machine of claim 1, further comprising a respective packing element at longitudinal ends of the volume for enclosing the volume.

3. The machine of claim 1, wherein the first packing element comprises a strip which is shaped to be introducible into a lateral gap between the rollers from below the rollers for partially defining the volume.

4. The machine of claim 3, wherein the exterior surface of the first packing element has a contour which permits it to extend into the gap at least approximately to a narrowest location of the gap.

5. The machine of claim 1, further comprising means for fastening the pressure box to be immovably supported in the interior of the first roller.

6. The machine of claim 1, further comprising:

at least fourth and fifth packing elements extending circumferentially along the pressure box between the outer surface of the pressure box and the inner surface of the roller shell, the fourth and fifth packing elements, respectively, being disposed at longitudinal ends of the first roller, at least one of the fourth and fifth packing elements being longitudinally displaceable along the roller for adjusting width of the pressure box in correspondence with the width of the web roll.

7. The machine of claim 1, further comprising a first connection of the pressure box to the source of gas pressure and a second connection of the pressure box to a source of vacuum.

8. The machine of claim 1, wherein the first support roller includes a vacuum zone upstream and in front of the pressure zone with respect to a rotation direction of the roller shell, the perforated roller shell passing over the vacuum zone so that reduced pressure is transmitted through the perforated roller shell outside the vacuum zone.

9. The machine of claim 1, further comprising first, second and third support rollers arranged alongside each other, the first and third support rollers defining a first bed for a first web roll and the second and third support rollers defining a second bed for a second web roll, wherein a single web of material may be cut into the first web roll having a first width on the first bed and the second web roll having a second width on the second bed.

10. The machine of claim 9, wherein the first support roller includes means therein for defining separated, longitudinally positioned pressure zones along respective longitudinal parts of the the support roller.

11. The machine of claim 10, where at least the first and second support rollers have respective pressure zones.

12. The machine of claim 10, wherein each of the first and second support rollers for defining the respective first and second beds has a respective vacuum zone which is circumferentially separated from the pressure zone.

13. The machine of claim 12, wherein each of the vacuum zones is located circumferentially upstream of and directly in front of the pressure zone in a direction of rotation of the respective support rollers.

14. The machine of claim 12, wherein the support rollers of each of the beds has a respective single vacuum zone which extends substantially over at least the entire width of the respective web on the roller along an axis of the respective support rollers.

15. The machine of claim 10, further including means in and disposed at positions along at least the first support roller for adjusting the length of the individual pressure zones and for adjusting the quantity of the individual pressure zones within the first support roller.

16. The machine of claim 15, wherein the pressure box has;

a plurality of longitudinally disposed sections along the axis of the first support roller;

a respective connection between each of the sections of the pressure box and the pressure source; and a respective individually controllable valve at each of the connections to the sections of the roll.

17. The machine of claim 15, wherein the pressure box includes:

a continuous pressure chamber along the entire width of the first support roller;

a grid body opening toward the interior of the perforated roller shell, the grid body having a plurality of grid walls extending from the axis toward the interior of the perforated roller shell for forming packing gaps between neighboring ones of the grid walls and at the interior of the roller shell;

a hole extending through the grid body along the axis of the one roller and forming a recess in each of the grid walls;

respective sealing disks disposed within the pressure box and selectively placeable at any of the grid walls for closing the respective recesses therein for defining the width of a pressure region along the pressure box axially between successive grid walls having sealing disks positioned thereat; and a plurality of valves connected with the pressure box at locations axially therealong for supplying pressure selectively to each of the pressure regions of the pressure box respectively defined between two selectively positioned grid walls.

18. The machine of claim 1, further including means in and disposed at positions along at least the first support roller for adjusting the length of each of the individual pressure zones and also the quantity of the individual pressure zones within the first support roller.

19. The machine of claim 18, wherein the pressure box has:

a plurality of longitudinally disposed sections along the axis of the first support roller;

a respective connection between each of the sections of the pressure box and the pressure source; and a respective individually controllable valve at each of the connections to the sections of the roll.

20. The machine of claim 18, wherein the pressure box includes:

a continuous pressure chamber along the entire width of the first support roller;

a grid body opening toward the interior of the perforated roller shell the grid body having a plurality of grid walls extending from the axis toward the interior of the perforated roller shell for forming packing gaps between neighboring ones of the grid walls and at the interior of the roller shell;

a hole extending through the grid body along the axis of the one roller and forming a recess in each of the grid walls;

respective sealing disks disposed within the pressure box and selectively placeable at any of the grid walls for closing the respective recesses therein for defining the width of a pressure region along the pressure box axially between successive grid walls having sealing disks positioned thereat; and a plurality of valves connected with the pressure box at locations axially therealong for supplying pressure selectively to each of the pressure regions of the pressure box defined between two selectively positioned grid walls.

21. The machine of claim 18, wherein the pressure box includes:

a continuous pressure chamber along the entire width of the first support roller;

a grid body opening toward the interior of the perforated roller shell, the grid body having a plurality of grid walls extending from the axis toward the interior of the perforated roller shell for forming packing gaps between neighboring ones of the grid walls and at the interior of the roller shell;

a hole in each of the grid walls enabling pressure communication axially through each grid wall;

blocking means placeable in the roller shell for selectively blocking the holes in selected ones of the grid walls for defining the width of a pressure region along the pressure box between axially successive grid walls having blocking means thereat.

22. The machine of claim 21, further comprising a plurality of valves connected with the pressure box at locations axially therealong for supplying pressure selectively to each of the pressure regions of the pressure box respectively defined between two selectively positioned grid walls.

23. The machine of claim 1, wherein the gas is air.

24. A machine for winding or unwinding a web roll of material having a width and a weight, the winding machine comprising:

at least first and second support rollers, each having a peripheral surface along its width, the support rollers being disposed proximate to one another such that the peripheral surfaces rollably support the web roll;

a rotatable and perforated roller shell forming the peripheral surface of the first support roller and having an inner surface defining an interior, the shell being rotatable about a stationary axis;

a gas pressure box being connectable to a source of pressurized gas and located in the interior of the perforated roller shell of the first support roller, the pressure box having an outer surface which includes an opening for permitting the pressurized gas to pass;

a first packing element having an exterior surface in slidable communication with the peripheral surfaces of the support rollers and extending along their widths;

means for defining longitudinally positioned pressure zones disposed within the first support roller along respective longitudinal parts of the support roller;

means for adjusting lengths of the longitudinally positioned pressure zones and for adjusting the quantity of the pressure zones, the means for adjusting being located within the first support roller;

the exterior surface of the first packing element, the peripheral surfaces of the rollers and an area of the web roll between the peripheral surfaces of the rollers defining a volume substantially beneath the web roll; and circumferentially spaced apart second and third packing elements extending longitudinally along the pressure box between the outer surface of the pressure box and the inner surface of the perforated roller shell for defining a pressure zone between the second and third packing elements;

the opening in the pressure box communicating with the pressure zone and the pressure zone communicating with the volume through the perforations in the roller shell such that gas pressure is increased in the volume which counteracts the weight of the web roll.

* * * * *